United States Patent [19]

Clark

[11] 4,356,578

[45] Nov. 2, 1982

[54] OBSTETRICS BED

[76] Inventor: Philip H. Clark, 2036 S. 13th East, Salt Lake City, Utah 84105

[21] Appl. No.: 187,514

[22] Filed: Sep. 15, 1980

[51] Int. Cl.[3] ..... A61G 7/00

[52] U.S. Cl. ..... 5/66; 5/73; 5/80

[58] Field of Search ..... 5/66-69, 5/308, 72, 74 R, 60, 62, 404; 269/323-325; 128/361; 209/322, 327

[56] References Cited

U.S. PATENT DOCUMENTS

| | | | |
|---|---|---|---|
| 690,844 | 1/1902 | Edwards | 5/67 |
| 2,517,681 | 8/1950 | Koerper | 5/66 |
| 3,118,153 | 1/1964 | Hood | 5/464 |
| 3,419,920 | 1/1969 | Maddox, Jr. et al. | 5/464 |
| 3,846,857 | 11/1974 | Weinstock | 5/464 |
| 4,034,972 | 7/1977 | Peterson | 269/324 |
| 4,139,917 | 2/1979 | Fenwick | 5/66 |
| 4,270,233 | 6/1981 | Mulligan | 269/325 |

FOREIGN PATENT DOCUMENTS

| | | | |
|---|---|---|---|
| 2922734 | 12/1980 | Fed. Rep. of Germany | 269/325 |
| 2015872 | 9/1979 | United Kingdom | 5/60 |

*Primary Examiner*—Roy D. Frazier
*Assistant Examiner*—Michael F. Trettel
*Attorney, Agent, or Firm*—B. Deon Criddle

[57] ABSTRACT

A bed for use by obstetricians and their patients. The bed and the bed mattresses are made sectional such that when the sections are assembled a full bed, with mattress, is formed on which one or more persons can recline. When the sections are separated to form a delivery station, a head section provides a torso support with an adjustable back rest and an adjustable pelvis support. A foot section of the bed, when separated from the head section, has a removable mattress and a frame that serves as a seat for the attending physician, provides storage compartments for necessary equipment and provides working surfaces to receive such equipment during use.

13 Claims, 8 Drawing Figures

OBSTETRICS BED

BRIEF DESCRIPTION OF THE INVENTION

1. Field of the Invention

This invention relates to hospital patient beds and particularly to such beds as are intended to be used during the birth of babies.

2. Prior Art

It has become more and more widely recognized that the birth of a baby and the comfort of the delivering mother can be greatly facilitated if the mother can be placed in a proper position dependent upon the nature of the delivery. It is also important in facilitating the birth that the attending physician or other assistant be properly positioned to examine the delivering mother, to assist the delivery and to receive the baby.

In the past, various kinds of articulated and variable height beds have been used in hospitals to achieve desired positioning of the woman giving birth. Such beds are shown, for example, in U.S. Pat. Nos. 2,647,026, and 4,057,240.

U.S. Pat. No. 4,139,917 also shows a hospital bed height labor, delivery and patient care bed that is used to facilitate birth of babies. The bed shown in this patent provides for separation of component parts so that an attending physician can move into a location that will allow him to better assist in the delivery. The bed also provides for the upper torso of the patient to be elevated during delivery.

So far as I am aware, however, there has not heretofore been available, an obstetrics bed that can be made to be of essentially normal bed height, as distinguished from the usual raised hospital bed, and that will provide for the comfort and proper positioning of the patient while comfortably accommodating the attending physician or assistant.

OBJECTS OF THE INVENTION

Principal objects of the invention are to provide a bed that is comfortable and easy to use for a woman in labor, and that can be readily manipulated to properly position the woman for delivery at the time of birth.

Other objects are to provide such a bed that is made in component, separable parts that can additionally provide a comfortable and complete delivery station for a physician attending the delivery.

Still another object is to provide a bed that will serve as a storage center for equipment necessary to facilitate delivery of a baby.

FEATURES OF THE INVENTION

Principal features of the invention include a bed having a two-part base, with the parts being separable to provide a delivery station.

The base includes a head section that serves to provide the patient upper body support and an equipment storage center and a foot section that provides a mattress support when used as part of the patient's bed and that serves as a physician's seat and work center.

The head section includes an adjustable back rest and a centrally maneuverable pelvic area covered by a single mattress section. Leg support areas of the head section and the foot section, when assembled to be contiguous with the head section are covered with another mattress section. Caster wheels are provided beneath the head section and at least some of the wheels are provided with locking means to permit the head section to be locked against undesired movement.

The foot section of the base is of generally L-shaped configuration, with one leg extending centrally into the head section and the other leg forming a continuation of one side of the head section. An opposite side of the head section extends alongside the foot section when the head and foot sections are assembled. The leg of the foot section extending into the head is bifurcated to form a physicians seat and a swinging storage compartment and the other leg of the foot section provides a back rest for the physician as well as storage for equipment items that may be necessary during a delivery. Caster wheels provided beneath the foot section and at least some of the caster wheels are of a locking type that can be immobilized to prevent undesired movement of the foot section.

Other objects and features will become apparent to persons skilled in the art from the following detailed description and claims.

THE DRAWINGS

In the drawings:

FIG. 1 is a perspective view of the assembled obstetrics bed of the invention with the mattress sections in a flat condition;

FIG. 2, a similar view, with the backrest and pelvic area raised and the mattress section for the foot section of the support base removed;

FIG. 3, a fragmentary sectional view through the mattress sections, taken on the line 3—3 of FIG. 1;

FIG. 4, a view like that of FIG. 1, but with both mattress sections removed;

FIG. 5, a view like that of FIG. 2, but with both mattress sections removed;

FIG. 6, a transverse section view, taken on the line 6—6 of FIG. 4;

FIG. 7, a longitudinal section view taken on the line 7—7 of FIG. 4; and FIG. 8, a fragmentary sectional view, taken on the line 8—8 of FIG. 7;

DETAILED DESCRIPTION

Figure 1:
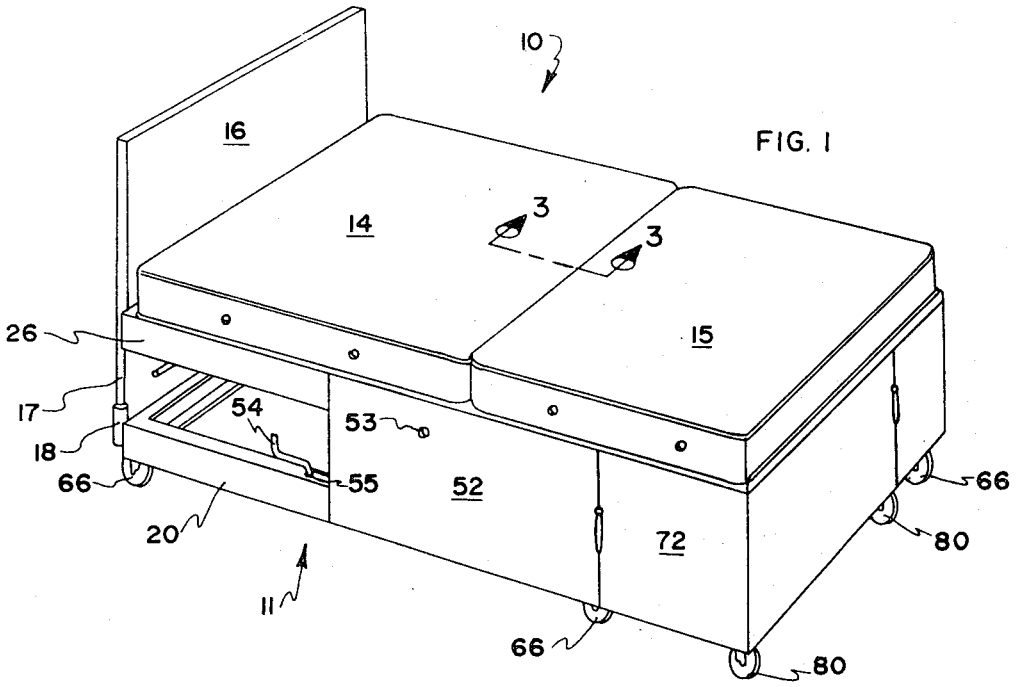

Referring now to the drawings:

In the illustrated preferred embodiment, the obstetrics bed of the invention, shown generally at 10, comprises a base 11 made up of a head section 12 and a foot section 13. A first mattress section 14 fits on the head section 12 to provide support for the upper body portion of a person reclining on the assembled bed 10. A second mattress section 15 abuts the mattress section 14, and rests on the foot section 13 and a portion of the head section 12, to provide support for the lower body of a person reclining on the assembled bed 10. A headboard 16 may be attached to the head section 12. As shown, the headboard 16 has legs 17 that are inserted into tubular receptors 18 on the head section. It will be apparent, however, that the headboard can be bolted, welded or otherwise affixed to the head section 12 by other conventional means.

The head section 12 has a bottom border frame 19 made up of interconnected channel members 20. A pair of posts 21 and 22 extend upwardly from channel members 20 at opposite sides of the bed and are interconnected at their upper ends by an angle iron brace 23.

Hinges 24 on the brace 23 are fixed to the brace 23 and to a backrest shown generally at 25. The backrest includes a box frame made up of interconnected channel members 26 and a top cover plate 27. An angle member 28 has one leg 28*a* centrally fixed to channel members 26 at opposite ends of the backrest and the other leg 28*b* has a guide slot 29 extending essentially the full length of the leg and short spaced apart, angled slots 30 extending from the slot 29.

Figure 7:
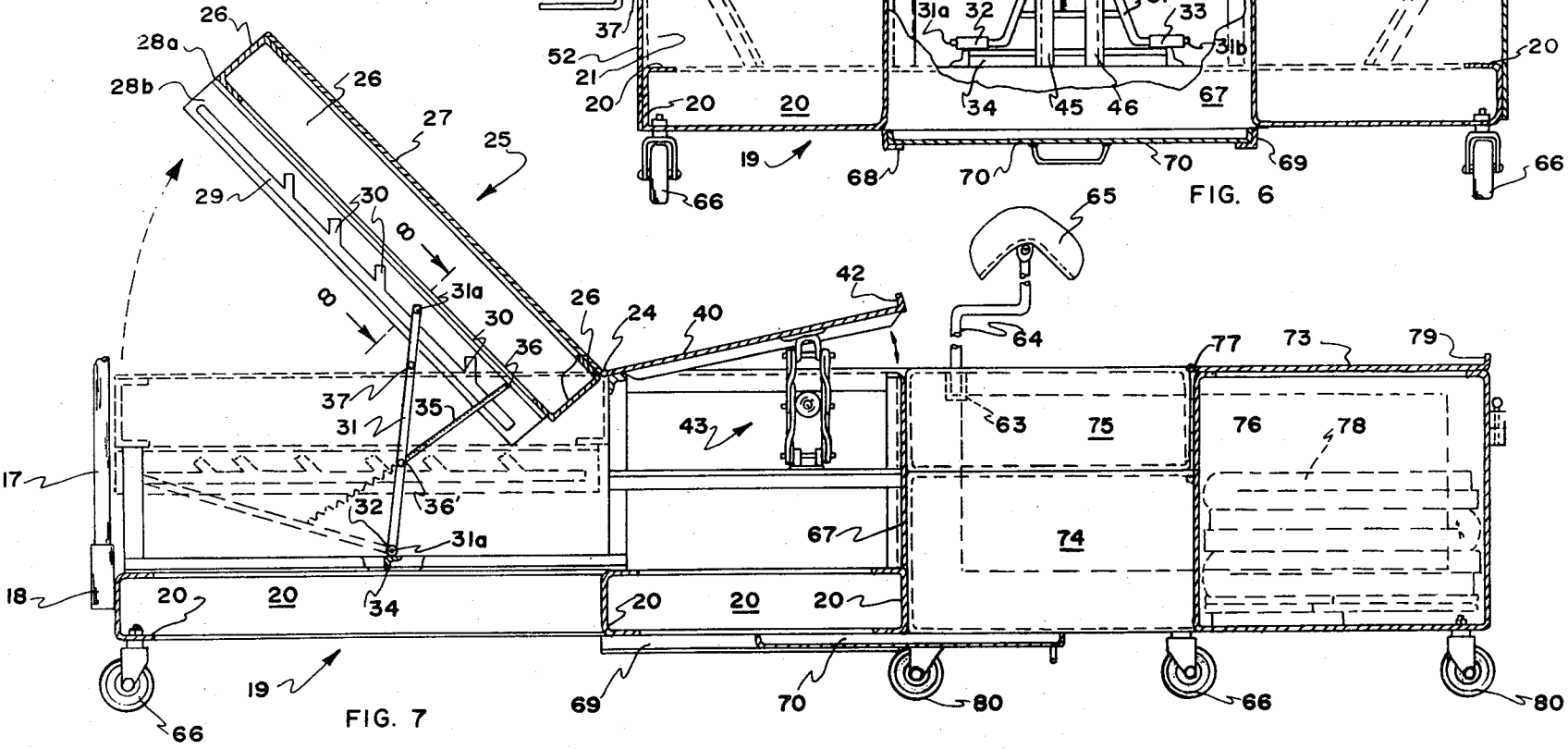

A generally U-shaped backrest support member 31 has a web 31*a* that extends through the slot 29 or a slot 30 and has ends 31*b* and 31*c* respectively journaled in sleeves 32 and 33 that are fixed to a cross brace 34 that extends between spaced apart channel members 20. A spring 35 is connected at 36 to the backrest support member and at 36' to angle member 28. Thus, it will be apparent that raising of the backrest will move the web 31*a* out of a slot 30 and into slot 29. An arm 37 projects from the backrest support member 31 to the side of the bed and provides a means by which an operator can hold the web 31*a* out of the slots 30 and in the slot 29 as the backrest is raised and lowered. As best seen in FIG. 7, when the backrest 25 is fully lowered to a level bed position, a channel member 26 rests on posts 38 that are fixed to and extend upwardly from a channel member 20 making up frame 19.

The head section 12, further includes a pelvic support plate 40 attached to the brace 23 by hinges 41. The pelvic support plate extends from brace 23 in a direction opposite to backrest 25 and has an upturned lip 42 at the edge remote from the hinges 41. As will be further explained, the lip 42 will keep the mattress section 14 from slipping off the head section during use of the bed 10 for delivery purposes.

Figure 2:
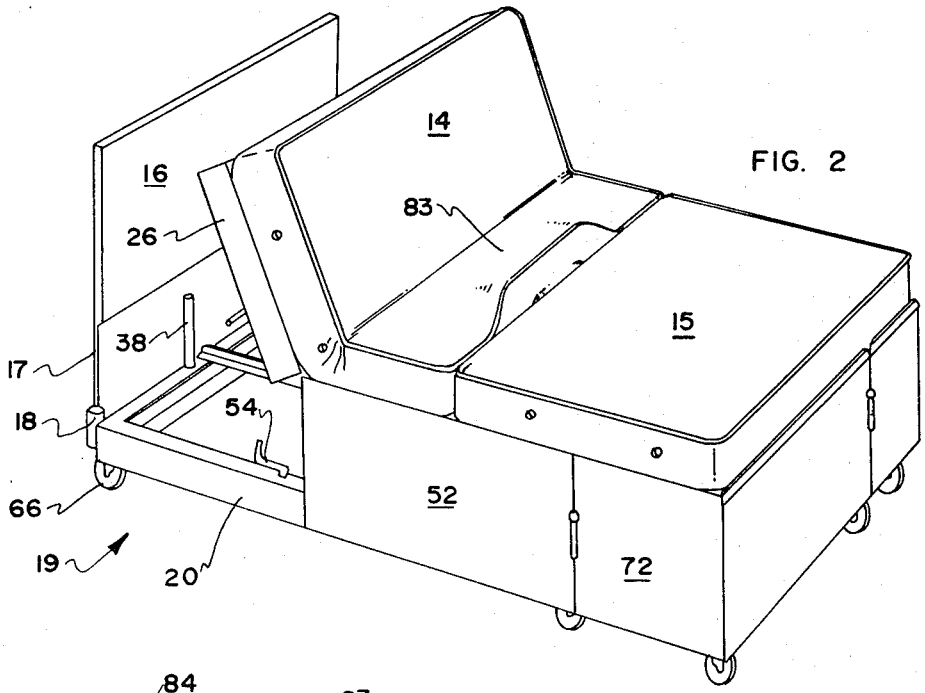
Figure 4:
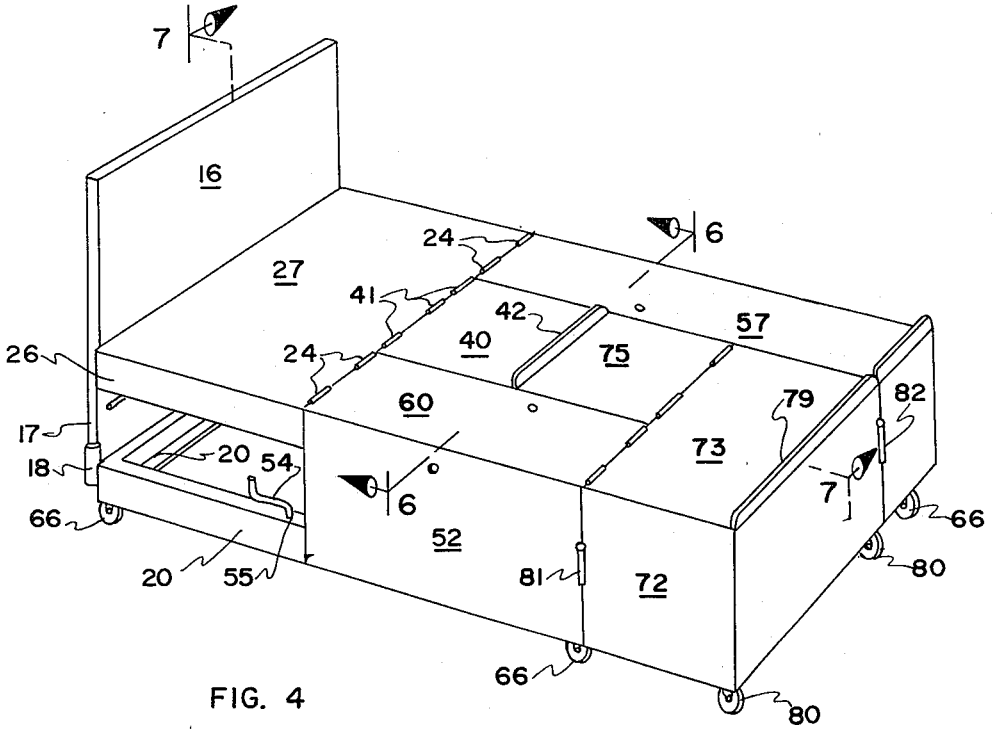

A scissors lift 43 is mounted beneath the pelvic support plate 40 on a plate 44 mounted on posts 45 and 46 that project upwardly from a channel member 20. An extension rod 47 has one end 48 attached to the drive shaft 49 of the scissors lift and a socket 50 at the other end journaled in a housing 51. Housing 51 is fixed to a side plate 52 that has a hole 53 therethrough opening into the housing 51, such that one end of a crank 54 (FIGS. 5 and 6) may be inserted thereinto to turn the rod 47 and the attached drive shaft 49. Rotation of the drive shaft, in conventional fashion, operates the scissors lift to raise and lower the pelvic support plate about its hinge connections. The crank 54 may be withdrawn from hole 53 and may be stored by inserting one end thereof in a hole 55 in a channel member 20 as best seen in FIGS. 1, 2 and 4, located beneath the backrest 25.

Head section 12 includes a long cabinet extension 56 projecting from top cover plate 27 at one side of the pelvic support plate 40 and a short cabinet extension 57 projecting from the plate 27 at the other side of the pelvic support plate. Both cabinet extensions are carried by the bottom border frame 19. The side plate 52 forms an outer wall for the short cabinet extension and a side plate 58 forms an outer wall for the long cabinet extension. Each cabinet extension is formed with an upwardly opening cabinet space in which items that may be used during a birth are to be stored. Top plates 59 and 60 of the long cabinet extension 56 and the short cabinet extension 57, respectively, lie in the plane of the top cover plate 27, when the backrest 25 is in its fully lowered position.

Holes 61 and 62 are provided through the top plates 59 and 60, respectively, and a socket 63 is mounted beneath each of the holes to receive a support leg 64 of a stirrup 65, as will be further explained.

Caster wheels 66 are preferably provided beneath the border frame 19 at the corners thereof to facilitate movement of the head section 12. At least some of the wheels 66 are also desirably of a locking type so that they can be fixed to immobilize the head section 12.

A partition 67 extends between the long and short cabinet extensions 56 and 57, beneath the lip 42 of the pelvic support plate 40.

Spaced apart angle members 68 and 69 are fixed to channel members 20 and provide supports and guides for a drip pan 70. The drip pan is shallow and may be pushed fully beneath the head section 12 or may be pulled out from beneath partition 67 to collect any liquids or other materials that may drop during a birth.

Foot section 13 is of generally L-shape configuration. One leg of the foot section is formed as a box 72, the top surface 73 of which is arranged to form a continuation of the top plates 59 and 60 when the foot section 13 and head section 13 are nested together, as will be further explained. The other leg of the foot section is formed from a lower fixed box section 74 and a pivotable upper box section 75. The lower box section is fixed to and extends from a face of box 72, at one side thereof, and the upper box section 75 is attached to box 72 by a hinge 76 such that section 75 will swing into a position overlying the section 74, or a position extending towards the side of box 72 at which section 74 extends.

The top surface 73 is preferably hinged at 77 to a wall of the box 72 so that it can be raised to permit storage of blankets 78 (FIG. 7) or other items in the box. A lip 79 extends upwardly from the free end of top surface 73 to hold the mattress section 15 in place, as will be further explained.

Caster wheels 80 are mounted beneath corners of the box 72 and the box section 74 so that the foot section 13 may be moved with respect to the head section 12. The caster wheels 80, like the caster wheels 66 of the head section are preferably of a locking type so that the foot section can be immobilized, if desired.

Figure 5:
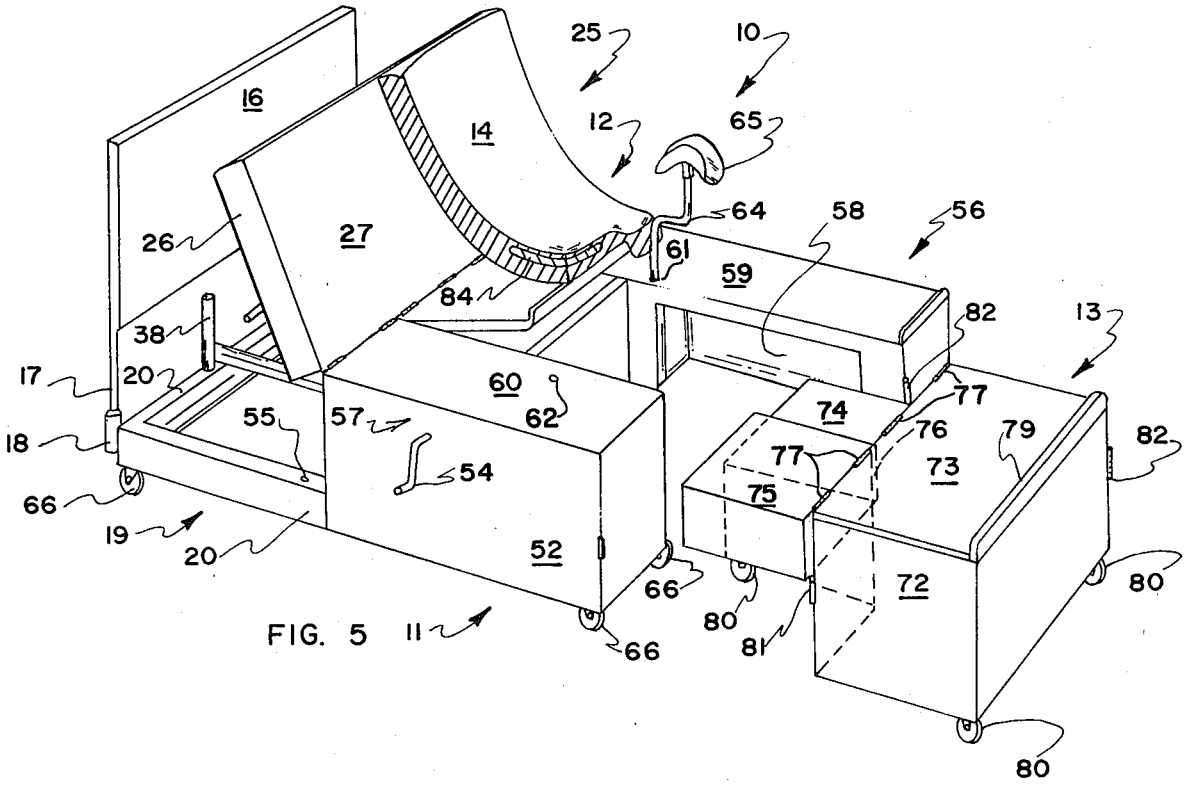
Figure 6:
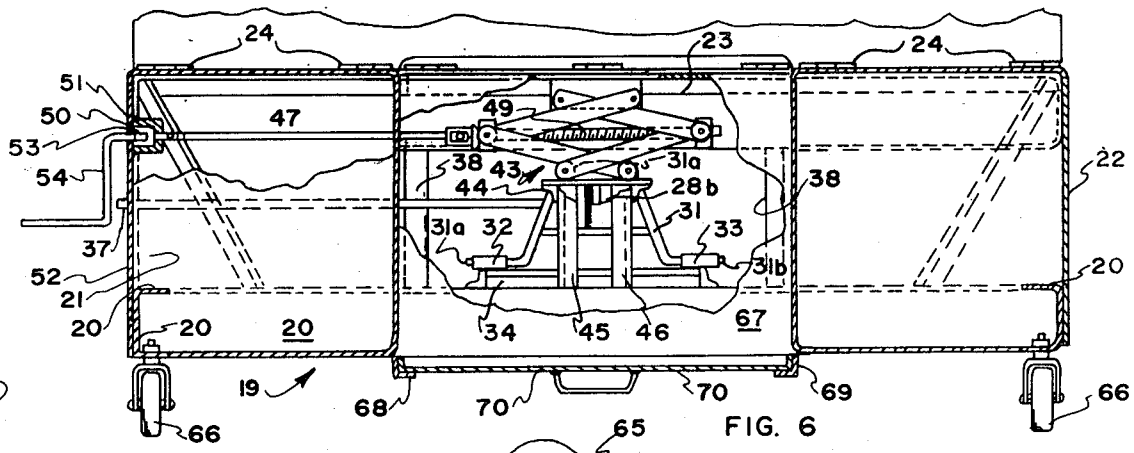
Figure 8:
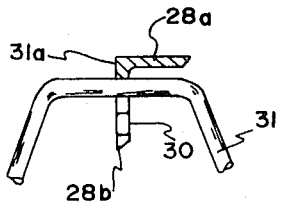

The obstetrics bed of the invention is used either with the head and foot sections in an assembled or nested arrangement (FIG. 4) or with the foot section separated from the head section (FIG. 5). When the head and foot sections are assembled the upper box section 74 is pivoted into position overlying the bottom box section 74 and the foot section is moved to position the box sections 74 and 75 snugly between the long cabinet extension 56 and the short cabinet extension 57, with the upper surface of box section 75 and the top surface 73 forming continuations of the top plates 59 and 60 and top cover plate 27. The mattress sections 14 and 15 are placed in position and a full sized bed of normal bed height is provided. The bed is particularly useful in labor rooms of hospitals and the like since it provides a comfortable, easily used bed on which a woman preparing to give birth may rest.

Figure 3:
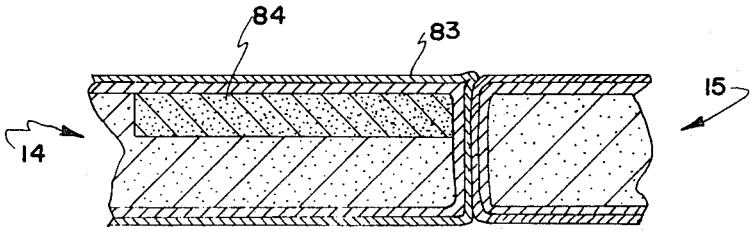

When it comes time to deliver the baby the mattress section 15 is removed and latches 81 and 82, which lock the head and foot sections together are released. The foot section is rolled to the position shown in FIG. 5 and the box section 75 is pivoted from over the box section 74. The backrest 25 is raised and crank 54 is operated to pivot the pelvic support plate 40 upwardly, and to thereby raise the reinforced more heavily padded central portion 83 of the mattress section 15 that extends over the pelvic support plate. As shown best in FIG. 3, the central portion 83 of mattress section 15 includes an extra firm foam rubber pad 84 beneath the top cover of the mattress. This insures a comfortable seat for the woman user even when the pelvic support plate is raised. The stirrups 65, which may be stored in one of the cabinet extensions 56 and 57, when not in use, are positioned by inserting their support legs 64 in sockets 63, such that the woman sitting on the central portion 83 and with her back resting on the raised backrest 25 can drape her legs over the stirrups. It has been found and is well recognized that this position is highly advantageous for most deliveries.

The Sim's delivery position can also be readily accommodated. In this position, the mother reclines on her side and in some instances it may be desirable that her top leg be raised and supported. With the backrest 26 lowered the patient can be positioned on her side, with her lower torso resting on top plate 59. Pillows, blankets or other padding can be provided on the top plate 59 as cushioning for the patient, if desired. The patient's upper leg can then be raised and positioned on stirrup 65, if necessary, during the delivery.

The lower box section 74, when positioned as shown in FIG. 5, serves as a seat for the doctor or other person attending the delivery.

It will be apparent that the means for raising and lowering of the backrest could be easily mechanized and that different kinds of lifts could be used to replace the scissors lift shown at 43.

Although a preferred form of my invention has been herein disclosed, it is to be understood that the present disclosure is made by way of example, and that variations are possible without departing from the subject matter coming within the scope of the following claims, which subject matter I regard as my invention.

I claim:

1. An obstetric bed comprising:

a head section having a support base;

a backrest carried by said support base and forming one end of said head section;

hinge means pivotally connecting said backrest to said support base;

means for rotating said backrest about said hinge means between a raised position and a lowered level bed position and for locking said backrest in selected positions relative to said support base;

a long extension carried by the support base and extending from the hinge means, said long extension having a top surface forming a planar continuation of the backrest surface when the backrest is in its lowered level bed position;

a short extension carried by the support base and extending from the hinge means, said short extension having a top surface forming a planar continuation of the backrest surface when the backrest is in its lowered level bed position and extending parallel to and spaced from the long extension;

a generally L-shaped foot section having a first leg sized to fit snugly between the long and short extensions and a top thereof forming a planar continuation of the top surfaces of the long and short extensions when the first leg is fitted snugly between the extensions and a second leg from which the first leg projects, said second leg forming a continuation of the short extension and engaging the long extension when the first leg is fitted snugly between the extensions, whereby an upper surface thereof is contiguous with the upper surfaces of the long and short extensions and the upper surface of the first leg; and wheel means beneath the foot section whereby the foot section is movable with respect to said head section and the first leg is movable from between the extensions.

2. An obstetric bed as in claim 1, wherein the first leg of the foot section includes a lower seat portion, and an upper mattress support portion movable from above the lower seat portion.

3. An obstetric bed as in claim 2, wherein the lower seat portion is fixed to and projects from the second leg, and the upper portion is pivotally mounted to the second leg.

4. An obstetric bed as in claim 1, wherein the support base includes a pelvic support section interconnecting the ends of the long extension and the short extension adjacent to the hinge means, said pelvic support area including a pelvic support plate between the extensions and pivotally connected to pivot about the hinge means.

5. An obstetric bed as in claim 4, including a first mattress carried by the backrest and the pelvic support section.

6. An obstetric bed as in claim 5, including a second mattress carried by the long extension, the short extension and the generally L-shaped foot section.

7. A obstetric bed as in claim 5, wherein the first mattress includes a pad of material having more rigidity than the rest of the said mattress, said pad of material being positioned over the pelvic support plate.

8. An obstetric bed as in claim 5, further including a lip on the pelvic support plate to hold the first mattress thereon during pivoting of the pelvic support plate and use of the bed.

9. An obstetric bed as in claim 5, wherein the first leg of the foot section includes a lower seat portion, and an upper portion movable from above the lower seat portion.

10. An obstetric bed as in claim 9, wherein the lower seat portion is fixed to and projects from the second leg, and the upper portion is pivotally mounted to the second leg.

11. An obstetric bed as in claim 4, wherein the first leg of the foot section includes a lower seat portion, and an upper portion movable from above the lower seat portion.

12. An obstetric bed as in claim 6, wherein the first leg of the foot section includes a lower seat portion, and an upper portion movable from above the lower seat portion.

13. An obstetric bed as in claim 12, wherein the lower seat portion is fixed to and projects from the second leg, and the upper portion is pivotally mounted to the second leg.

* * * * *